United States Patent [19]

Bass et al.

[11] 4,149,366

[45] Apr. 17, 1979

[54] THREADING METHOD AND THREADING DEVICES FOR DISC-TYPE FRICTION TWISTERS

[75] Inventors: Dieter Bass; Joachim Fogger; Udo Hänsel, all of Dormagen, Fed. Rep. of Germany

[73] Assignee: Bayer Aktiengesellschaft, Leverkusen, Fed. Rep. of Germany

[21] Appl. No.: 858,824

[22] Filed: Dec. 8, 1977

[30] Foreign Application Priority Data

Dec. 14, 1976 [DE] Fed. Rep. of Germany ..... 2656528

[51] Int. Cl.[2] ..... D01H 7/92

[52] U.S. Cl. ..... 57/280; 57/284; 57/339

[58] Field of Search ..... 57/34 R, 51.5, 77.3, 57/77.33, 77.4, 77.42, 106, 107, 156, 157 R, 157 TS, 34.5

[56] References Cited

U.S. PATENT DOCUMENTS

| | | | |
|---|---|---|---|
| 3,872,661 | 3/1975 | Eaves | 57/77.4 |
| 3,911,661 | 10/1975 | Naylor | 57/77.4 |
| 3,955,350 | 5/1976 | Shuster | 57/77.4 |
| 3,973,383 | 8/1976 | Yu | 57/77.4 |
| 3,998,041 | 12/1976 | Graf et al. | 57/77.4 |
| 4,047,374 | 9/1977 | Venot | 57/77.4 X |
| 4,050,229 | 9/1977 | Hayahusa et al. | 57/77.4 |
| 4,059,948 | 11/1977 | Derail et al. | 57/77.4 X |

*Primary Examiner*—Donald Watkins
*Attorney, Agent, or Firm*—Plumley and Tyner

[57] ABSTRACT

Threading procedure in the texturing method for endless filaments in false-twist texturing machines comprising disc-type twisters.

9 Claims, 6 Drawing Figures

THREADING METHOD AND THREADING DEVICES FOR DISC-TYPE FRICTION TWISTERS

This invention relates to a texturing method for endless filaments of at least partly thermoplastic manmade materials on false-twist texturing machines comprising disc-type twisters.

Disc-type twisters for the false-twist texturing of synthetic manmade filaments are already known, consisting of three disc sets rotating in the same direction which are arranged on three parallel shafts forming the corner points of an equilateral triangle in such a way that the discs are staggered overlapping one another in the manner of spiral stairs. The yarn to be false-twisted travels in a three-dimensional curve over the edges of the discs. One of the difficulties involved in the operation of these disc-type twisters is encountered during start-up, when the yarn has to be threaded between the overlapping discs.

In some arrangements, this difficulty is obviated by pivotally mounting one or all three disc sets so that the yarn can be threaded in straight form and the unit is only closed after the threading operation (cf. German Offenlegungschrifts Nos. 2,213,147; 2,213,881 and 2,452,206). Units which operate on this principle or a similar principle are technically complex and involve the danger that the stringent demands on the accuracy of the disc assembly are not always satisfied on account of soiling and wear. However, the dimensional tolerances have to be very closely observed, particularly for high texturing speed. For this reason, disc-type twisters with a fixed spacing between shafts are preferred.

German Offenlegungsschrift No. 2,361,674, describes an arrangement with a fixed shaft spacing in which the yarn is adjustable between a initial position around the friction discs and a false-twist position and which is distinguished by the fact that the yarn is additionally brought into a stable intermediate position in which it contacts at least one friction element of at least one spindle.

German Auslegeschrift No. 2,444,530 describes a similar unit in which an adjustable filament holder is also provided and, in addition, deflecting elements project into the middle of the unit to guide the filament, after it has been released from the filament holder, laterally inwards into the unit between the discs in such a way that the yarn is delivered by the discs moving towards the centre of the unit without coming into contact with those discs of which the peripheries move outwards from the centre of the unit.

Finally, German Offenlegungsschrift No. 2,401,776 describes another similar unit in which the yarn travels through a pivotal guide which is adjustable between a thread-up position and a false-twist position.

One disadvantage common to all three of these known units is that they are unsuitable for speeds in excess of 700 m/minute. If the twister rotates at a corresponding working speed, the yarn breaks when it is forced into the region of the disc overlap in the manner described. It is an object of this invention to provide a method which avoids the disadvantages mentioned above and to provide a method of false-twist texturing, which enables the yarn to be threaded at the working speed of the twister and texturing machine.

Further objects of this invention will be evident from the following description.

These objects are accomplished by a method of false-twist texturing of endless filament yarn which consists at least partly of thermoplastic manmade materials, wherein the yarn is textured in a false-twist texturing machine comprising disc-type twisters which consist of three disc sets which rotate in the same direction and which are arranged on three parallel shafts forming the corner points of an equilateral triangle and having fixed spacings in such a way that the discs overlap one another in the manner of spiral stairs and, in operation, the yarn travels through the twisters along a spiral three-dimensional curve, and wherein (a) the texturing machine and twisters operate at speeds which correspond to a texturing speed of from 700 to 1500 m/minute, (b) the feed yarn is run onto a waste take-up during the threading procedure, (c) the yarn is delivered in steps by only one disc of one shaft at a time into the region of the disc overlap, (d) the yarn is not subjected to the draft or overfeed required for texturing, determined by the different delivery and take-up speeds, till it is travelling through the twister along its spiral three-dimensional curve, and (e) the yarn is transferred from the waste device to the take-up tube on completion of the threading procedure.

During the threading method, the yarn to be textured is offwound onto a waste device, delivered in steps by one disc of one shaft into the region of the overlap, subsequently subjected to the draft required for texturing and, on completion of this sequence of the threading procedure, is transferred from the waste device to the take-up tube.

According to the principle of the invention, additional, individually pivotal filament guides would have to be arranged adjacent each delivery disc, for example in the unit described in German Auslegeschrift No. 2,444,530, as will be explained hereinafter. However, the surprising advantage of the method according to the invention is that, for certain disc combinations, the step-by-step transport into the overlap zone may readily be obtained by varying the yarn tension.

Further objects of this invention are accomplished by advantageous further developements of and improvements in the method claimed in claim 1.

It is particularly advantageous to use a false twister which comprises four, five or more discs with a high coefficient of friction and an entry disc and exit disc with a low coefficient of friction.

The coefficient of friction is defined by the equation:

$$S_2/S_1 = e\,\mu \cdot \phi$$

in which $S_2/S_1$ represents the ratio between the yarn tensions at the friction element and $\phi$ represents the wrapping angle. The coefficient of friction $\mu$ may be determined by pulling the particular yarn over the friction disc at a required wrapping angle and measuring the ratio $S_2/S_1$.

$S_2/S_1$ represents the ratio between the yarn tensions at the friction element and $\phi$ represents the wrapping angle. The coefficient of friction $\mu$ may be determined by pulling the particular yarn over the friction disc at a required wrapping angle and measuring the ratio $S_2/S_1$.

Ring twisting spindles or air suction nozzles are best used as the take-off means.

In one preferred embodiment of the method according to the invention, the step-by-step delivery of the yarn is effected by only one disc at a time by gradually increasing the yarn tension after the twister. At the same time, the yarn passes through a conventional filament guide before and after the twister, these filament guides being pivotal either individually or together.

In another preferred embodiment of the invention, the twister is arranged inclined in the direction of yarn travel in front of the twister corresponding to the "natural" entry and exit angle. In particular, the direction of yarn travel in front of the twister and the axial direction of the disc shafts may be substantially parallel to one another. However, the yarn should leave the last disc at its "natural" exit angle.

In another advantageous variant of the method, the take-up unit is arranged offset behind the twister.

The method according to the invention is particularly advantageously carried out by providing individually pivotal filament guides which release the yarn in steps from a loop around the discs so that the yarn is only taken up by one disc at a time of the shaft 7 and fixed filament guides keep the yarn away from the discs of the shaft 8 during its travel into the region of the common disc overlap (cf. FIGS. 2 and 2*a*).

Embodiments of the invention are described by way of example in the following with reference to the accompanying drawings, wherein.

Figure 2:
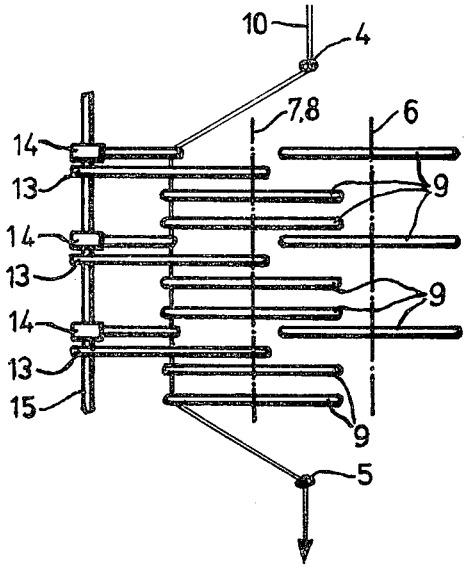
FIG. 2 is a side elevation of an improved attachment unit for disc twisters comprising more than four twisting discs.
Figure 2A:
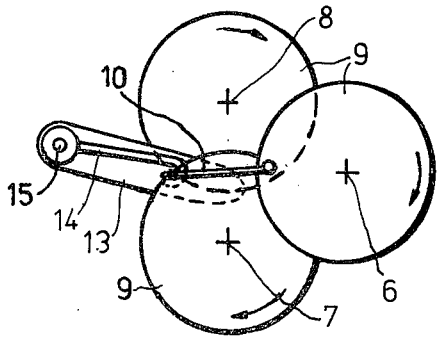

FIG. 2*a* is a plan view of the unit shown in FIG. 2.

Figure 3:
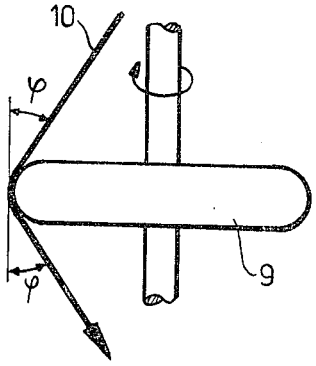

FIG. 3 is a side elevation showing the travel of the yarn over the edge of a disc.

Figure 3A:
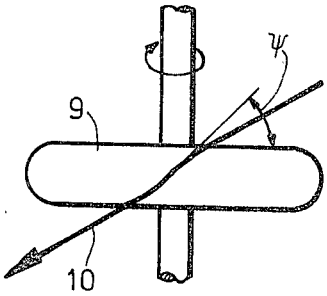

FIG. 3*a* is another side elevation showing the travel of the yarn over the edge of a disc.

Figure 4:
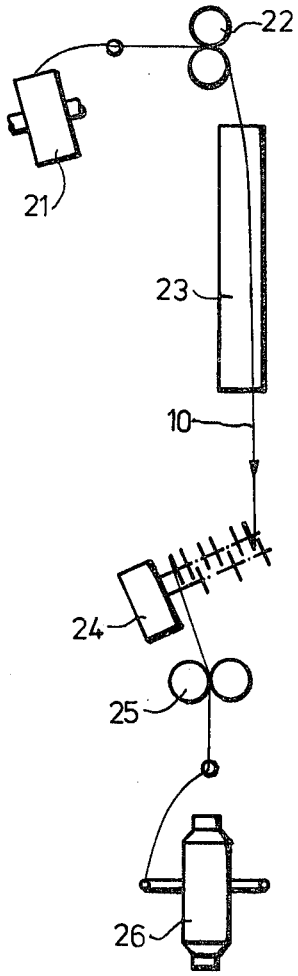

FIG. 4 shows the inclined position in which the twister is arranged for obtaining the "natural" entry and exit angle of the yarn.

The threading method (cf. FIG. 1) comprises (a) running the undrawn feed yarn onto a waste take-up (not shown) adjacent the unit, (b) inserting the travelling yarn into a filament guide in front of and behind the disc assembly, with the twister already rotating at its working speed, in such a way that the yarn travels in the gap between the discs of the shafts 7 and 8 (see FIG. 1), and (c) gradually increasing the take-up force on the travelling yarn.

It has been found that, with increasing yarn tension the yarn is delivered first by the lower disc of the shaft 7 and then by the upper disc of the shaft 7 into the region of the disc overlap without breaking. It should be noted that the yarn should only be subjected to drawing after it has been introduced into the twister. The waste take-up may be, for example, the waste ring of a ring-twisting spindle or a filament suction device. The yarn tension may be increased in several ways, for example by means of known yarn brakes arranged in front of the twister where the yarn is taken off at a constant speed, or by increasing the take-up speed where the yarn is delivered at a constant speed.

In the drawings described in detail in the following, the same reference numerals denote the same or corresponding elements.

Figure 1:
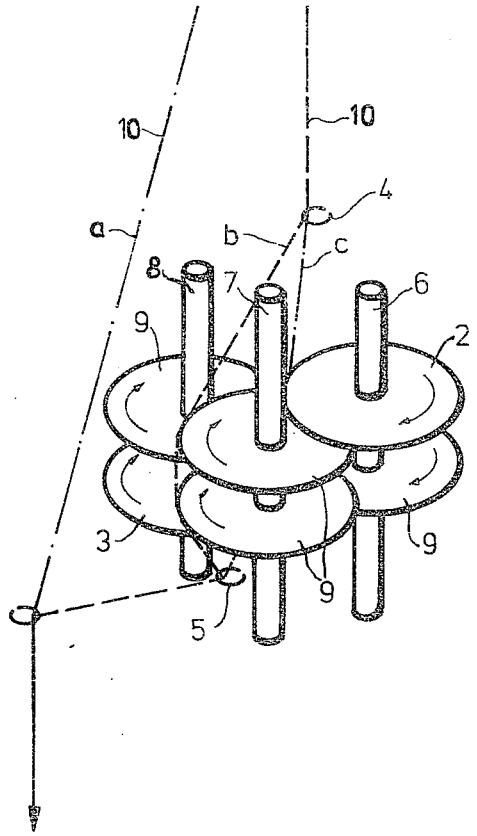
FIG. 1 is a perspective view of the threading method.

FIG. 1 illustrates the threading method by way of example in the case of a twister comprising four discs 9 with a high coefficient of friction, and an entry disc 2 and an exit disc 3 with a low coefficient of friction, which are rotated clockwise by the shafts 6, 7 and 8. The feed yarn 10 is first brought into position a adjacent the unit, set in motion by a waste take-up (not shown) and then brought into position b, i.e. threaded into filament guides 4 and 5 in such a way that it travels in the gap between the discs of shafts 7 and 8, the yarn being run onto the waste take-up under low tension. When the take-up tension is increased, the lower disc 9 of the shaft 7 first comes into action and delivers the yarn into the overlap zone. When the take-up force is further increased, the upper disc 9 of the shaft 7 also comes suddenly into action, in other words the yarn reaches its working position c and may then be subjected to the draft required for texturing and subsequently transferred from the waste device to the take-up tube.

This threading method may also be carried out with a twister in which the entry disc 2 mounted on the shaft 6 is replaced by a disc having a high coefficient of friction.

In cases where more than four discs having a high coefficient of friction and an entry disc and exit disc with a low coefficient of friction are used, additional filament guides are necessary. FIG. 2 for example is a side elevation of a twister comprising a total of nine discs 9 which are mounted on the shafts 6, 7 and 8. A first set of fixed filament guides 13 is used to lift the yarn 10 off the discs of the shaft 8 during its delivery into the overlap zone by means of discs of the shaft 7. A second set of pivotal filament hooks 14 enables the yarn to be released step-by-step onto the discs of the shaft 7 in accordance with the concept of the invention. The filament guides 13 and 14 are mounted together on a shaft 15. FIG. 2*a* is a plan view of the arrangement illustrated in FIG. 2.

A major advantage of the claimed threading method always arises when the total number of all the discs amounts to an integral multiple of 3, i.e. 3, 6, 9, etc. Hitherto, it has been standard practice to guide the yarn substantially parallel to the shaft axes in front of and behind each disc assembly. However, there are so-called "natural" entry and exit angles for each special arrangement of discs having certain dimensions. When these "natural" angles are obtained, the feed method is particularly reliable and the quality of the textured yarn is improved.

As shown in FIGS. 3 and 3*a*, the curve along which the yarn 10 travels over the edge of a disc 9 is characterised by the wrapping angle $\phi$ (FIG. 3) and the traversing angle $\psi$ (FIG. 3*a*). However, this means that the direction of the straight length of yarn between the discs is spatially inclined towards the axis of the shafts. The lengths of yarn should show a corresponding inclination in front of the first disc and behind the last disc. It is these inclinations which are meant to be understood in the following as the "natural" entry and exit directions.

It can readily be shown that these "natural" entry and exit directions only are parallel to one another and fall in one plane when the sum of all the discs is an integral multiple of 3, i.e. 3, 6, 9, etc.

In practice, the desired geometry of yarn travel may be obtained, for example, by correspondingly inclining the shaft axes towards the direction of yarn travel normally determined by the machine as shown in FIG. 4.

This has the advantage that the filament does not undergo any additional changes in direction at filament guides known per se in front of and behind the disc assembly.

FIG. 4 shows the travel of the yarn 10 from a delivery bobbin 21 over a first delivery unit 22, a heat setting stage 23, through the inclined disc twister 24 and over a second delivery unit 25 to a take-up bobbin 26.

In an advantageous alternative, only the "natural" exit angle is obtained in that, although the direction of yarn travel in the texturing zone up to the twister runs substantially parallel to the shaft axis, the second delivery unit is arranged offset relative to the, for example, vertical filament path. In this way, the yarn leaves the twister outside the drive mechanism (for example shaft bearings, gear belt and the like) normally arranged below the disc assembly.

In addition, the choice of a total of 3, 6, 9, etc. discs enables the unit to be readily switched from the S- to the Z-texturing direction without the direction of filament travel having to be changed.

We claim:

1. A method of false-twist texturing of endless filament yarn which consists at least partly of thermoplastic manmade materials, wherein the yarn is textured in a false-twist texturing machine comprising disc-type twisters which consist of three disc sets which rotate in the same direction and which are arranged on three parallel shafts forming the corner points of an equilateral triangle and having fixed spacings in such a way that the discs overlap one another in the manner of spiral stairs and, in operation, the yarn travels through the twisters along a spiral three-dimensional curve, and wherein (a) the texturing machine and twisters operate at speeds which correspond to a texturing speed of from 700 to 1500 m/minute, (b) the feed yarn is run onto a waste take-up during the threading procedure, (c) the yarn is delivered in steps by only one disc of one shaft at a time into the region of the disc overlap, (d) the yarn is not subjected to the draft or overfeed required for texturing, determined by the different delivery and take-up speeds, till it is travelling through the twister along its spiral three-dimensional curve, and (e) the yarn is transferred from the waste device to the take-up tube on completion of the threading procedure.

2. The method of claim 1, wherein the twister comprises four discs with a high coefficient of friction and an entry disc and an exit disc with a low coefficient of friction.

3. The method of claim 1, wherein the twister comprises five discs with a high coefficient of friction and an exit disc with a low coefficient of friction.

4. The method of claim 1, wherein the step-by-step delivery of the yarn by only one disc at a time is obtained by gradually increasing the yarn tension behind the twister and the yarn travels through a filament guide in front of and behind the twister.

5. The method of claim 4, wherein the twister is arranged inclined towards the direction of the yarn path corresponding to the "natural" entry and exit angle.

6. The method of claim 4, wherein the direction of the yarn path in front of the twister and the axial direction of the disc shafts are substantially parallel to one another, but wherein the yarn leaves the last disc at its "natural" exit angle.

7. The method of claim 6, wherein the take-up unit is arranged offset behind the twister.

8. The method of claim 1, wherein individually pivotal filament guides are provided which release the yarn in steps from a loop around the discs so that the yarn is only taken up by one disc of shaft at a time and fixed filament guides keep the yarn away from the discs of a second shaft during its travel into the region of the common disc overlap.

9. The method of claim 8, wherein at least one of the filament guides is pivotally arranged.

* * * * *